US006749662B2

(12) United States Patent
Bueneman et al.

(10) Patent No.: US 6,749,662 B2
(45) Date of Patent: Jun. 15, 2004

(54) STEEL BALLISTIC SHOT AND PRODUCTION METHOD

(75) Inventors: Morris C Bueneman, Florissant, MO (US); Jack D. Dippold, Edwardsville, IL (US); Brian Mravic, North Haven, CT (US); Howard Muldrow, St. Charles, MO (US); Peter W. Robinson, Branford, CT (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 09/901,849

(22) Filed: Jul. 9, 2001

(65) Prior Publication Data

US 2002/0026967 A1 Mar. 7, 2002

Related U.S. Application Data

(63) Continuation-in-part of application No. 09/329,475, filed on Jun. 10, 1999, now Pat. No. 6,258,316.
(60) Provisional application No. 60/117,735, filed on Jan. 29, 1999.

(51) Int. Cl.[7] ..... B22F 9/08
(52) U.S. Cl. ..... 75/338; 75/351; 148/208; 148/513
(58) Field of Search ..... 75/337, 338, 351; 148/208, 513

(56) References Cited

U.S. PATENT DOCUMENTS

| | | | | |
|---|---|---|---|---|
| 224,858 | A | 2/1880 | Wintherlich et al. | |
| 2,201,900 | A | 5/1940 | Kalling et al. | 148/16 |
| RE21,500 | E | 7/1940 | Rennerfelt | 75/28 |
| 2,289,897 | A | 7/1942 | Balke et al. | 75/22 |
| 2,330,038 | A | 9/1943 | Ervin | 83/91 |
| 2,366,371 | A | 1/1945 | Tholand | 75/28 |
| 2,381,023 | A | 8/1945 | Wulff | 266/9 |
| 2,402,441 | A | 6/1946 | Paddle | 83/91 |
| 2,411,073 | A | 11/1946 | Whitney | 75/22 |
| 2,498,769 | A | 2/1950 | Ramage | 75/22 |
| RE23,538 | E | 8/1952 | Hancox et al. | 18/2.6 |

(List continued on next page.)

FOREIGN PATENT DOCUMENTS

| | | |
|---|---|---|
| DE | 887 661 | 7/1949 |
| DE | 24 53 881 | 11/1973 |
| JP | 02-163301 | * 6/1990 |

OTHER PUBLICATIONS

Ed Lowry, "The Status of Non–Toxic Shotshells", Ameircan Rifleman, Mar. 1999, pp. 48–51, 71.
Erwin Industries, Erwin Amasteel Brochure, pp. 3–4, Date Unkown.
Erwin Industries, Erwin Amasteel Display Card, Date Unknown.
Roster, T., "Winchester's New Inexpensive Steel", Sporting Clays, Mar., 2000, pp. 24 and 25.
Beszny, L.P., "Winchester Shotshells 2000 A field Review", Wildfowl The Magazine for Duck & Goose Hunters, vol. 15, No. 4 (Feb./Mar. 2000), pp. 52–54.
Mazour, M., "Why Are Winchester Xpert Steel Loads Expensive?" www.outdoorsite.com/products/mazouir–win–xpert.html (printed Nov. 1, 1999).
Bourjaily, P., "Steel Shot Update", Field and Stream Online www.fieldandstream.com.huntinggunsbowsammo/fssteel-shot.html (Mar. 17, 2000).

(List continued on next page.)

*Primary Examiner*—George Wyszomierski
(74) *Attorney, Agent, or Firm*—Wiggin and Dana LLP; Gregory S. Rosenblatt; Michael K. Kinney

(57) ABSTRACT

A relatively high carbon, water-atomized, steel shot is softened via annealing to render it suitable for ballistic use. The annealing preferably includes decarburization from a surface layer or throughout and preferably provides the shot with a surface Knoop hardness of less than 250.

25 Claims, 10 Drawing Sheets

U.S. PATENT DOCUMENTS

| | | | | |
|---|---|---|---|---|
| 2,670,281 | A | | 2/1954 | Hutchison ..... 51/309 |
| 2,758,360 | A | | 8/1956 | Shelter et al. ..... 29/1.22 |
| 2,816,466 | A | | 12/1957 | Galdfelter et al. ..... 78/1 |
| 2,867,554 | A | | 1/1959 | Wilson et al. ..... 148/3 |
| 3,150,224 | A | | 9/1960 | Libman ..... 266/5 |
| 2,974,031 | A | | 3/1961 | Wilson et al. ..... 75/5 |
| 3,201,289 | A | | 8/1965 | Stewart ..... 148/13 |
| 3,204,320 | A | | 9/1965 | Eckstein et al. ..... 29/1.22 |
| 3,325,277 | A | | 6/1967 | Huseby ..... 75/5 |
| 3,333,987 | A | | 8/1967 | Schrader et al. ..... 148/2 |
| 3,597,188 | A | | 8/1971 | Neumann ..... 75/5 BA |
| 3,668,024 | A | | 6/1972 | Johnson ..... 148/126 |
| 3,687,654 | A | | 8/1972 | Huseby ..... 75/5 BA |
| 3,725,142 | A | | 4/1973 | Huseby ..... 148/16 |
| 3,764,295 | A | | 10/1973 | Lindskog et al. ..... 75/5 BA |
| 3,786,753 | A | | 1/1974 | Eckstein et al. ..... 102/42 |
| 3,887,402 | A | | 6/1975 | Kondo et al. ..... 148/126 |
| 3,900,317 | A | | 8/1975 | Meadus et al. ..... 75/211 |
| 3,903,761 | A | | 9/1975 | Runton ..... 76/101 |
| 3,951,035 | A | | 4/1976 | Dautzenberg et al. ..... 86/10 |
| 3,965,962 | A | | 6/1976 | Tanaka et al. ..... 164/55 |
| 3,987,730 | A | | 10/1976 | Meadus et al. ..... 102/42 |
| 4,023,985 | A | | 5/1977 | Dunkerley ..... 148/3 |
| 4,035,116 | A | | 7/1977 | O'Brien ..... 425/10 |
| 4,124,377 | A | | 11/1978 | Larson ..... 75/5 C |
| 4,402,884 | A | | 9/1983 | Koike et al. ..... 264/8 |
| 4,448,746 | A | | 5/1984 | Kubo et al. ..... 419/31 |
| 4,820,362 | A | | 4/1989 | Baldi ..... 149/2 |
| 5,408,931 | A | | 4/1995 | Tallman ..... 102/439 |
| 5,511,449 | A | | 4/1996 | Feigenbaum ..... 75/341 |
| 6,027,544 | A | * | 2/2000 | Arvidsson ..... 148/513 |
| 6,258,316 | B1 | * | 7/2001 | Buenemann, Jr. et al. ..... 420/8 |

OTHER PUBLICATIONS

Mann, M–J. et al. "Shot Pellets: An Overview", AFTE Journal, vol. 26, No. 3 (Jul., 194) pp. 223–241.

ANSI/SAAMI Z2292.–1992, American National Standard Voluntary Industry Performance Standards for Pressure and Velocity of Shotshell Ammunition for the Use of Commercial Manufacturers— "Definition of Lead & Steel Shot Hardness", p. 35, American National Institute, Inc. 1996.

"Compositions of Standard Steels", The Metals handbook, vol. 1–Properties and Selection of Metals, The American Society for Metals, 8$^{th}$ edition 1969, p. 62.

* cited by examiner

100x ▬▬ 100 μm

100x ▬▬ 100 μm 100x 100 μm 100x 100 μm

STEEL BALLISTIC SHOT AND PRODUCTION METHOD

CROSS-REFERENCE TO RELATED APPLICATIONS

This patent application claims priority of U.S. Provisional Patent Application Ser. No. 60/117,735 entitled "STEEL BALLISTIC SHOT AND PRODUCTION METHOD" that was filed on Jan. 29, 1999 and is a continuation-in-part of U.S. patent application Ser. No. 09/329,475 entitled "STEEL BALLISTIC SHOT AND PRODUCTION METHOD" that was filed on Jun. 10, 1999, now U.S. Pat. No. 6,258,316, the disclosure of which is incorporated by reference in its entirety herein.

BACKGROUND OF THE INVENTION (1) Field of the Invention

This invention relates to ammunition, and more particularly to steel shot utilized in shotshells.

(2) Description of the Related Art

Steel shot is utilized extensively in industry. Such shot may be used for surface treatment of metal parts by spraying a stream of the shot onto the surface in a process known as "shot peening". The shot may also be used as an abrasive.

One method of manufacturing industrial shot is by impinging a jet of water or other fluid onto a stream of molten steel. Upon contact with the water, the molten steel is atomized, forming spheroidal particles. By spheroidal it is meant "sphere-like" but not necessarily spherical or round. The particles fall into a water tank, cool and then are dried and sorted (by size and to segregate significantly out-of-round particles) and subjected to any further treatment. Particles which are either: too irregular in shape; or of a size exceeding the useful range, are crushed to form grit used for abrasive purposes (e.g., grit blasting). Industrial steel shot is typically very hard, with a Vickers hardness usually in excess of 400 DPH (all mechanical measurements are at room temperature, nominally 21° C.). To provide the desired hardness, the manufacturing process may utilize a relatively high carbon steel which may also include additional hardening elements such as silicon and manganese in quantities on the order of 1% by weight (all compositions are in weight percent unless otherwise indicated). One example of a process for manufacturing industrial shot is shown in U.S. Pat. No. 4,023,985 of Dunkerely et al., the disclosure of which is incorporated herein by reference in its entirety.

Steel shot is also utilized for ballistic purposes (i.e., to be loaded into shotshells for expulsion from shotguns). Steel shot has increasingly displaced lead-containing shot in various applications as the latter has become more strictly regulated. Ballistic steel shot is typically formed from a wire of a low carbon steel (e.g., SAE-AISI 1006 steel having a carbon content of less than 0.08%, a manganese content of 0.25–0.40%, a phosphorus content of less than 0.04% and a sulfur content of less than 0.05%). To prepare the ballistic shot, the wire is first cut to size (i.e., into approximately cylindrical pieces having the volume of the desired spherical shot pellets). Each piece is then mechanically deformed ("headed") in a die to partially form the piece into a sphere. A highly spherical (round) pellet is traditionally regarded as necessary to provide uniformity and consistency of dispersion when the shot is ultimately fired. Accordingly, the pieces are then placed in a groove between counter-rotating plates and formed into spheres, a grinding process akin to the formation of ball bearings. This produces a highly round shot pellet having a Vickers hardness of 200–250 DPH. The shot is then annealed to reduce the hardness to from about 90 to about 110 DPH, a level generally regarded as desirable to avoid wear of the gun barrel used to discharge the shot.

One key application for which steel shot has become popular is use in hunting waterfowl. Waterfowl loads (commonly known as duck loads) typically utilize American Standard #2 and #4 shot, having respective nominal diameters of 0.15 in and 0.13 in. Waterfowl loads are regarded as a relatively high performance use for which the market often demands high quality steel shot and is able to bear the associated costs of such shot. Upland game (dove and quail) loads and target loads typically utilize smaller pellets than waterfowl loads and still commonly utilize lead shot. Common lead shot utilized in upland game loads is typically between #6 and #8. The market for shotshells for these applications is such that the loaded shotshells retail for between about one-fourth and one-half of the price of waterfowl loads.

Industrial shot is typically smaller than ballistic shot. The diameter of industrial steel shot is typically from about 0.005 inch to about 0.08 inch. Ballistic steel shot is typically between about 0.09 inch (#8 shot) and about 0.20 inch (T-size) in diameter. These American Standard shot sizes convert to about 0.23 cm and 0.51 cm, respectively. Industrial shot is typically more irregular than ballistic shot. The atomization processes used to produce industrial shot end up producing a wide range of particle sizes and shapes potentially well off spherical. Sieving allows for size segregation and a spiral (helical) rolling process may be utilized to screen out the more egregiously misshapen particles and particles with density-reducing voids. Nevertheless, even with such quality control, atomized shot is generally very noticeably out of round.

BRIEF SUMMARY OF THE INVENTION

We have realized that common processes used to manufacture industrial shot produce a by-product which includes pellets too large for typical industrial use but of appropriate size for ballistic use. Such pellets have heretofore been crushed and used as lower value grit. We seek to take such pellets, soften them (as described below), and utilize them as ballistic shot (a higher value product). Broadly, this entails obtaining relatively high carbon steel shot of a composition suitable for industrial use and softening such shot to render it suitable for ballistic use at lower cost than that of traditional steel shot. The hardness which may be preferred or may be tolerated depends on a number of factors including pellet size. Other factors being equal, a relatively high level of hardness may be acceptable for relatively small diameter pellets. It may be possible to express the maximum acceptable hardness as a function of pellet diameter (e.g., by a linear approximation) for given circumstances or ranges thereof. For smaller pellets, an acceptable hardness may be achievable by an annealing process without substantial carbon removal. For larger pellets, obtaining acceptable hardness may require annealing with substantial to near total decarburization at least from a surface layer.

Accordingly, in one aspect, the invention is directed to a method for manufacturing shot useful for discharge from a shotgun. There is provided a source of molten steel having an initial carbon content. The molten steel is subjected to an atomization process so as to produce substantially spheroidal pellets. These pellets are annealed in a decarburizing atmosphere effective to decrease the carbon content in at least a surface layer of each of the pellets. The pellets are cooled, whereupon the surface layer has a median (median measured radially across the layer) Knoop hardness of less than 225 at 21° C.

In various embodiments, the surface layer may be at least 0.1 mm thick. The surface layer may be at least 0.3 mm thick. The surface layer may have a thickness of at least 1% of an average diameter of the associated pellet. The surface layer may have a thickness of 5%–10% of an average diameter of the associated pellet and the carbon removal may be effective to provide the surface layer with a Knoop hardness of less than 225 at 21° C. over substantially the entire surface layer. After annealing, a core region of each pellet may retain sufficient carbon so that the core region has a Knoop hardness in excess of 225 at 21° C. The core region may have an average diameter of at least 50% of an average diameter of the associated pellet.

The carbon removal may be effective to provide the surface layer with a Vickers hardness of no more than 180 at 21° C. over a majority of the surface layer. The carbon removal may be effective to provide the pellets with a Vickers hardness of between 130 and 180 at 21° C. substantially throughout.

The spheroidal pellets may have characteristic diameters between about 0.08 inch and about 0.23 inch. The spheroidal pellets may have preferably characteristic diameters between about 0.09 inch and about 0.16 inch. The spheroidal pellets may be #4 pellets and the atomization process may produce additional pellets and the method may further comprise separating the additional pellets from the #4 pellets prior to the annealing. The annealing may leave sufficient carbon in a core region of each pellet so that a majority of the core region has a Vickers hardness of more than 200 at 21° C. and the carbon removal may be effective to provide the surface layer with a Vickers hardness of between 130 and 180 at 21° C. over a majority of the surface layer. Prior to annealing, the pellets may have a composition by weight of 0.85–1.2% carbon, 0.4–1.2% manganese, 0.4–1.5% silicon, and remainder iron with up to 1% additional components.

In another aspect, the invention is directed to a method for efficient manufacturing of shot useful for discharge from a shotgun. There is provided a source of molten steel. The steel is subjected to an atomization process so as to produce particles. The particles are segregated into a plurality of groups based upon at least one parameter of particle size and particle shape. The plurality of groups include at least one group predominately designated for ballistic use wherein the particles are essentially spheroidal pellets having characteristic diameters between 0.08 inch and 0.23 inch and at least one industrial group predominately intended for industrial use. The spheroidal pellets of the ballistic group are annealed in a decarburizing atmosphere effective to remove carbon from a layer of each of said spheroidal pellets. The spheroidal pellets are allowed to cool, the carbon removal being effective to provide the layer with a Knoop hardness of less than 225 at 21° C. over a majority of the layer.

In various embodiments, the segregating may include segregating a plurality of such industrial groups of particle size and shape useful as industrial shot while leaving a first remainder of particles. The segregating further includes segregating at least one ballistic group from the first remainder of particles while leaving a second remainder of particles. The method may further include crushing the second remainder to form industrial grit useful for grit blasting.

In another aspect, the invention is directed to a shotshell. The shotshell has a hull, a propellant charge in a powder chamber within the hull and a primer carried within the base of the hull. A plurality of shot pellets are located within a forward portion of the hull with wadding between the propellant charge and the plurality of shot pellets. The shot pellets are formed by water atomization of molten steel and a subsequent carbon removal process which leaves the pellets with a surface Knoop hardness of less than 250 at 21° C.

In various implementations of the shotshell, prior to carbon removal the pellets may have significant quantities of carbon, silicon, and manganese (e.g., at least about 0.10% of each) and typically a much higher combined concentration of silicon and manganese (e.g., in excess of 0.80%). Preferred feed stock may have a composition by weight of 0.85–1.2% carbon, 0.4–1.2% manganese, 0.4–1.5% silicon, and remainder iron with up to 1% additional components. The carbon removal may be effective to provide the pellets with a Vickers hardness of between 130 and 180 substantially throughout.

In another aspect, the invention is directed to an iron-based shot pellet. The pellet has a body consisting by weight essentially of up to about 1.5% carbon, about 0.1% to about 2.0% silicon, about 0.4% to about 2.0% manganese, the balance iron with no more than about 3% additional material. The body has a surface Knoop hardness of less than 250 at 21° C. and optionally has a coating. In various embodiments, the pellet may have a silicon content from about 0.4% to about 1.5%. The silicon content may be from about 0.8% to about 1.2% while the manganese content may be from about 0.5% to about 1.2%. The carbon content may be from about 0.01% to about 0.15%. The body may have a characteristic diameter between about 0.08 inch and about 0.23 inch. The body may have a carbon-depleted surface layer having a Knoop hardness of less than 250 and a carbon-rich core having a Knoop hardness of more than 250.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
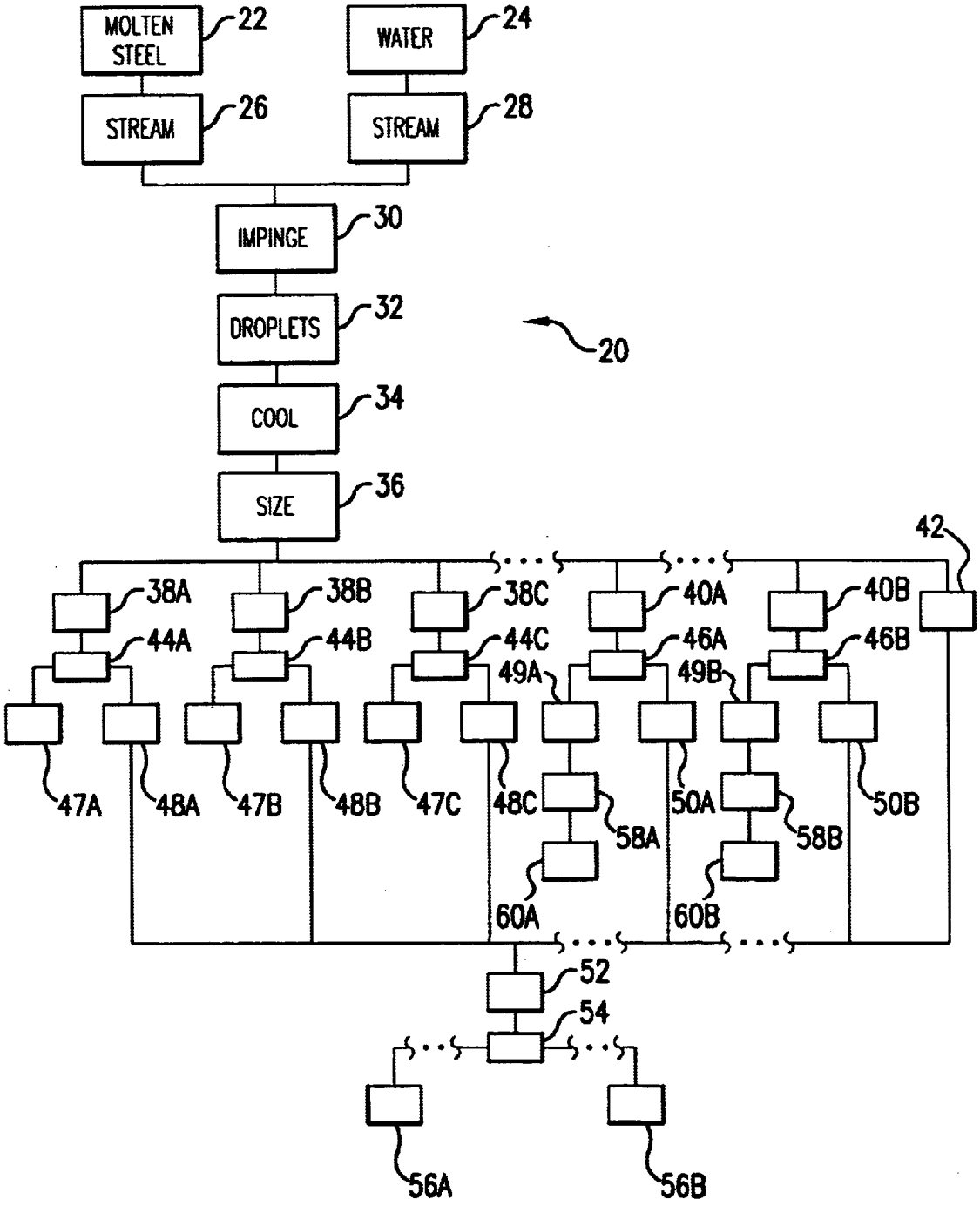
FIG. 1 is a flow chart illustrating an exemplary process of the co-production of industrial and ballistic steel shot according to principles of the invention.

FIG. 1 shows an exemplary process 20 for the coproduction of industrial shot and the inventive ballistic shot. A source 22 of molten steel and a source 24 of water are provided. The steel is a relatively high carbon steel (carbon content at least about 0.6% and more typically in excess of 0.8% by weight). An advantageously utilized steel has an approximate composition as follows: 0.85–1.2% C; 0.4–1.2% Mn; 0.4–1.5% Si; less than 0.05% S; and less than 0.05% P (remainder Fe and under 1% impurities). This steel is approximately consistent with the production of Society of Automotive Engineers (SAE) J827 Cast Steel Industrial Shot. The water may substantially be tap water.

The steel and water are formed into streams 26 and 28 which streams are impinged 30. The impingement produces droplets of steel 32 which are allowed to cool and solidify into particles. At this point, the particles have a Vickers hardness in excess of about 600. The particles are then size sorted via a sieving process 36 into a plurality of size groups 38, 40, and 42. The groups 38 (of which groups 38A–38C are shown, although more groups are preferably involved) are of sizes useful as industrial shot. By way of example, the groups 38 may represent groups defined in SAE specification J444 or a similar standard. The groups 40 (of which only 40A and 40B are shown, although there may preferably be additional groups) are suitable for ballistic use and may correspond to various American Standard Shot Sizes for steel shot. There may be some overlaps between the desired sizes of industrial and ballistic shot. Separation of the industrial shot from the ballistic shot in the overlapping groups may take place later in the process (although not shown in the exemplary embodiment). A final group or groups 42 represent sizes which are not useful or desired for either industrial or ballistic purposes, including oversized and undersized particles. Depending on the desired uses, there may be a size group of shot for which there is some demand for industrial and/or ballistic shot but not enough to utilize the entire production of such size, in which case, only the very best specimens of such size may be utilized for industrial or ballistic purposes with the remainder disposed of as described below.

The various groups 38 and 40 are then sorted for shape and density (lack of voids) in spiral rolling processes 44A–44C and 46A–46B (respectively collectively 44 and 46) in which the particles are rolled down a spiral track so that particles of lower density or lower roundness proceed relatively slowly and are thereby sorted out. The screening 44 separates the respective groups 38A–38C into groups 47A–47C (collectively 47) of acceptably round and dense particles and groups 48A–48C (collectively 48) of out-of-round or off-density particles. Similarly, the screening 46 separates the groups 40A–40B into groups 49A–49B (collectively 49) of acceptably round and dense particles and groups 50A–50B (collectively 50) of out-of-round or off-density particles thus the pellets in groups 49 are substantially spheroidal. One measure of the degree of sphericity is a ratio of maximum to minimum pellet diameter wherein a value of one would indicate a sphere. For the subject pellets, this ratio is advantageously measured using a flat-plate caliper or micrometer. The use of a flat-plate measurement avoids receiving particularly low minimum diameter figures associated with measurement from the bottom of a dimple, as would be obtained with calipers having sharpened measuring features. With flat plate calipers, when taking a measurement at the dimple, one plate will seat on the rim of the dimple and yield a higher measurement than would be obtained from the bottom. With this technique, it is preferred that a ratio of maximum to minimum diameters be no greater than 1.20, preferably no greater than 1.15, and more preferably no greater than 1.10. To the extent that even more nearly spherical pellets can be obtained without undue wastage or cost, this would be preferred. After this screening 44 and 46, the out-of-round or off-density (rejected) particle groups 48, 50 and 42 are then reverted to industrial usage and frequently subjected to a crushing process 52 to produce grit 54 which may be size sorted into a plurality of grit groups 56 (of which 56A and 56B are shown). Alternatively, the crushing process may be performed individually on the rejected groups rather than comingling them prior to crushing. At some point in the process, at least the pellets in the industrial groups may be heat treated to increase durability and reduce brittleness. Such heat treatment may reduce pellet hardness to in the vicinity of 400–500 DPH. The foregoing process is regarded as exemplary and various of the process steps described may be expanded, rearranged, or modified to accommodate the features of a pre-existing industrial shot manufacturing environment.

Figure 2:
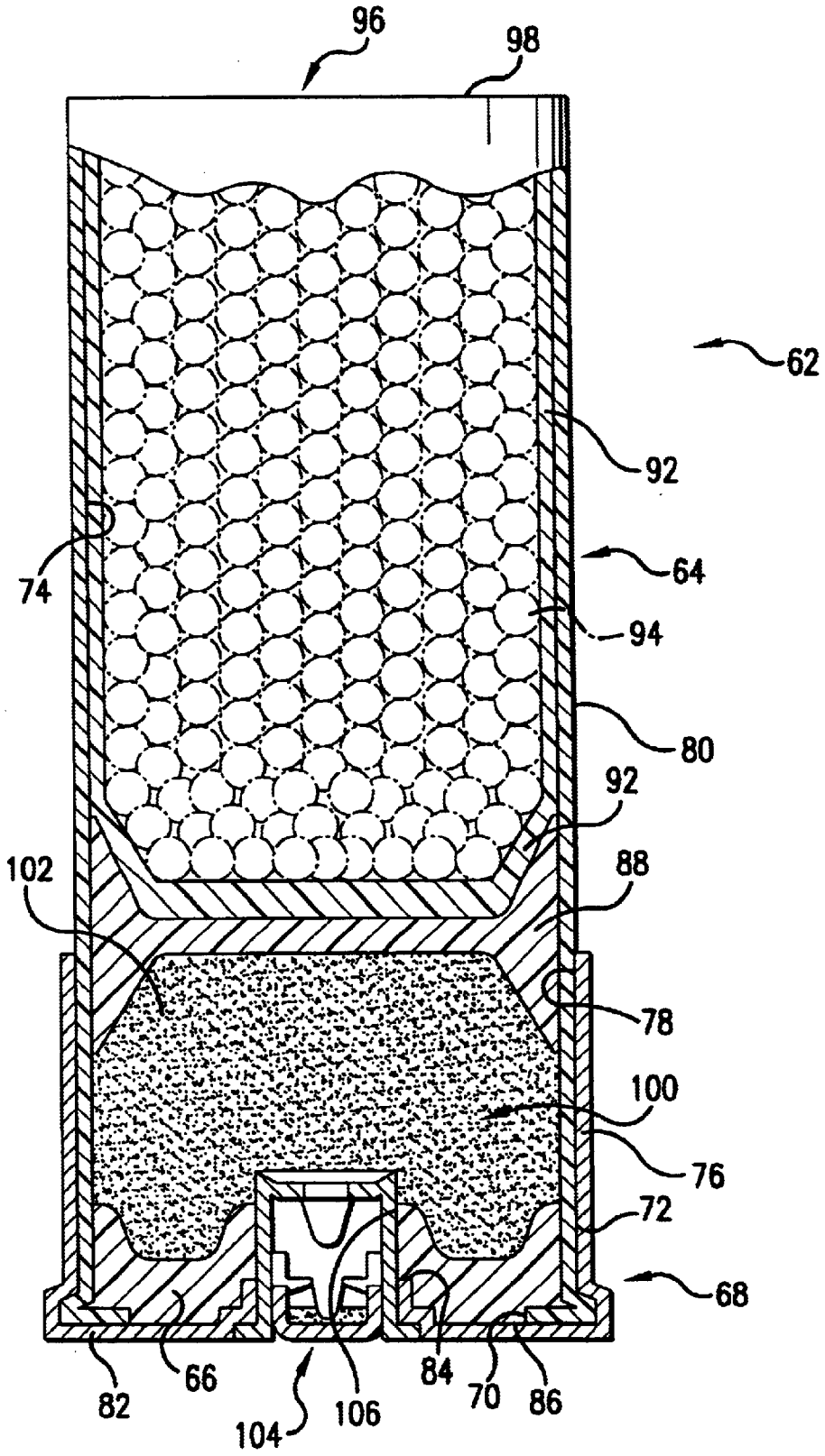
FIG. 2 is the longitudinal sectional view of a shotshell loaded with water-atomized steel shot according to principles of the invention.

The select ballistic particle groups 49 are then subjected to a heat treatment process 58A–58B which may be alternative or in addition to the heat treatment received by the industrial groups) which softens the pellets and may remove carbon either from at least a surface layer to the entire volume of the particles to produce groups 60A–60B ballistic shot. Advantageously, if decarburized, the carbon content in the area affected is reduced to below 0.15% (with a range of about 0.01% to about 0.10% being believed advantageous). The remaining components are largely unaffected. By way of example, the carbon may be removed by a solid state diffusion process accomplished by annealing the shot at a temperature of 600–1200° C. in a non-oxidizing atmosphere (e.g., such as 96% nitrogen-4% hydrogen bubbled through water). Other decarburization processes might alternatively be used. The carbon removal softens the shot and provides it with a hardness of between about 130 and 200 DPH, with a likely average of slightly below 180 DPH. Although the ballistic shot may be subjected to a rounding process (e.g., as is done with wire-formed shot) this presents a disadvantageous additional cost. Finally, the shot may optionally be oil coated or plated for corrosion resistance. The shot may then be packaged for bulk sale in packages labeled for use in loading shotshells or the shot may be preloaded into shotshells 62 (FIG. 2).

The geometries and dimensions of the shotshell 62 may be similar to or the same as any of a number of conventional shells (e.g. 20, 12, and 10 gage and the like). One exemplary shotshell 62 has a hull including a Reifenhauser tube 64, a basewad 66 and a metallic head 68. In the illustrated embodiment, the tube and basewad are separately formed of plastic although they may be unitarily formed. The basewad is located within the tube, proximate the aft end 70 thereof. An external lateral, primarily cylindrical, surface 72 of the basewad contacts an internal primarily cylindrical surface 74 of the tube. The metallic head has a sleeve portion 76 secured to the tube along aft portion thereof. An internal surface 78 of the sleeve contacts an external surface 80 of the tube. At its aft end, the sleeve flares outward to form a rim of the shotshell which compressively holds the flared aft end 70 of the tube to a beveled shoulder of the basewad. A web 82 spans the sleeve, extending inward from the rim, forming a base of the cartridge. The web 82 has a central aperture 84, adjacent which the web is deformed forwardly. The web contacts a generally annular aft surface 86 of the basewad 66. Contained with the tube and generally forward of the basewad is wadding which, in the exemplary embodiment, is the two-piece resilient plastic combination of an aft over-powder portion 88, and a fore shot cup 92. Other wadding, e.g., a similar unitarily-formed shotwad, may be used. The shot cup 92 contains a load of shot pellets 94. At its fore end 96, the tube is crimped such as via a star crimp 98.

The over-powder cup 88 includes an aft-facing concavity which, along with a fore-facing compartment of the basewad, defines a powder chamber 100 containing a propellant charge 102. To ignite the propellant charge, a primer 104 is carried with the basewad. The primer may be of conventional battery cup design such as a No. 209 shotshell primer. The primer 104 extends through the central aperture 84 of the head and a central aperture 106 of the basewad.

Although the carbon removal yields ballistic shot much softer than the industrial shot composition on which it is based, the decarburized shot may still be harder than typical wire-formed ballistic shot. The ballistic shot may also have higher levels of manganese and silicon than typical wire-formed steel ballistic shot. Advantageously, the shot pellets 94 in any given shotshell are drawn from a single one of the size groups 60. Particularly preferred groups are #4 (nominal size 0.13 in.) through #7 (nominal size 0.10 in.). The broader range of #2 (0.150 in.) through #9 (0.080 in.) may be useful and larger sizes (e.g., up through F-size (0.22 in.)) would be useful if the atomization process could be configured to produce such a size with sufficient roundness and uniformity. Existing atomization processes for producing industrial shot are, however, typically optimized to produce shot sizes useful for industrial shot and, therefore, do not intentionally typically produce significant quantities of very large shot (e.g., F-size).

Figure 3:
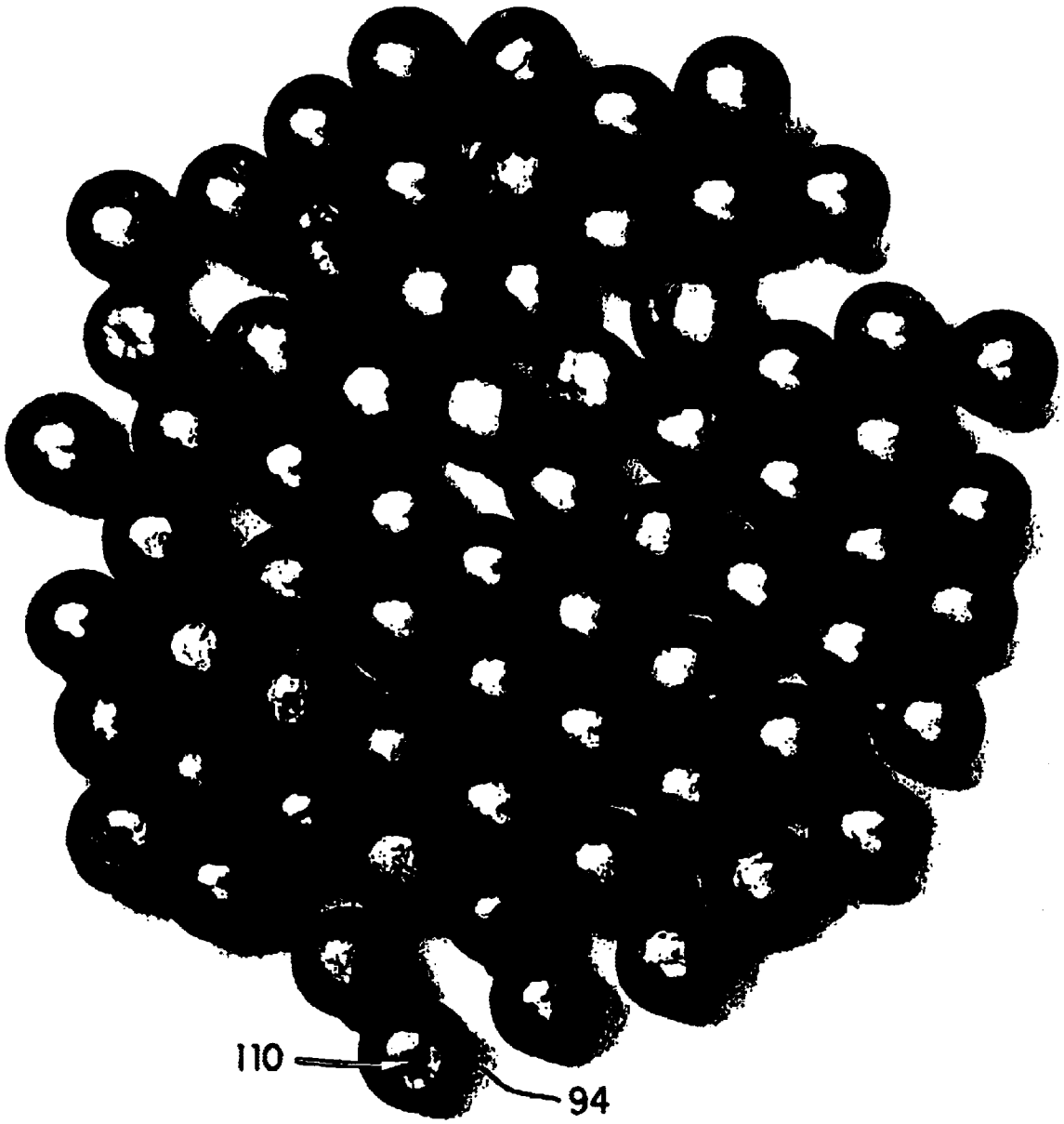
FIG. 3 is a photograph of water-atomized steel shot.

FIG. 3 shows #7 water atomized steel shot 94 after screening for roundness and density. The individual shot pellets are substantially spheroidal. An artifact of the atomization process is the common presence of an inwardly projecting dimple 110 in what is otherwise a spheroidal surface that is nearly spherical (the screening process removing more eccentric pellets). Such a dimple would be expected to have dramatic adverse performance on the ballistic properties of the shot. However, as described with reference to the firing tests below, this is not necessarily the case.

EXAMPLES

Decarburization

Decarburization reduces the hardness of the steel by removing the carbon via a solid state diffusion process. This can be accomplished by annealing in a non-oxidizing atmosphere of controlled dew point, such as 96% nitrogen-4% hydrogen bubbled through water prior to entry into the furnace. Other hydrogen-nitrogen mixtures, including pure hydrogen, may conveniently be utilized. The preferred temperature range is 600–1200° C. with higher temperatures generally resulting in faster diffusion and thicker decarburized layers in a fixed amount of time. The decarburized layer should be thick enough to prevent barrel damage when fired from a shotgun. The thickness required may vary with the size and quantity of the shot pellets, the thickness of the wadding surrounding the shot column and the velocity at which the shot travels down the barrel.

Example 1

Figure 4:
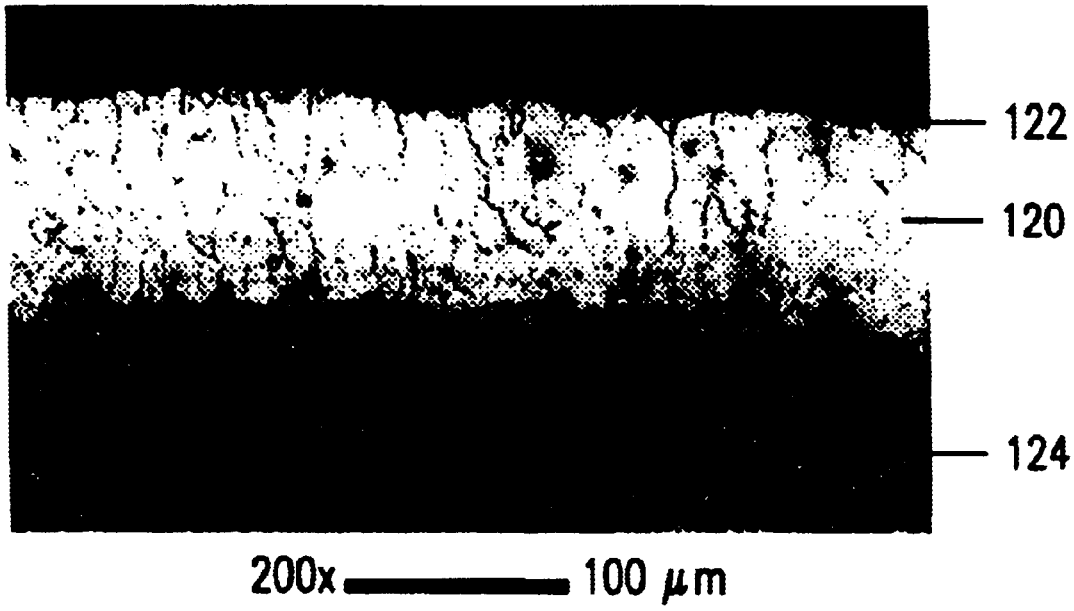
FIG. 4 is a 200× photomicrograph of an exemplary partially decarburized steel shot according to principles of the invention.

An initial decarburization experiment was performed on 147 mil diameter shot by annealing in wet 96% nitrogen-4% hydrogen at 705° C. for 2 hours. A uniformly decarburized zone or layer 120 about 0.004 inch in depth was produced via this treatment. The layer 120 can be seen in FIG. 4 which is a photomicrograph of a sectioned pellet at 200× magnification. The thickness of the layer 120 is measured by via use of a ruler on a micrograph of known magnification. The measurement is taken at an undimpled location radially inward from the pellet surface 122 to a point where there is appreciable undecarburized material as evidenced by a beginning of a visible transition to the undecarburized core 124. The hardness of the decarburized layer and the un-decarburized core were 129 and 281 DPH, respectively. This compares with an as-received hardness of 465 DPH.

Example 2

Figure 5:
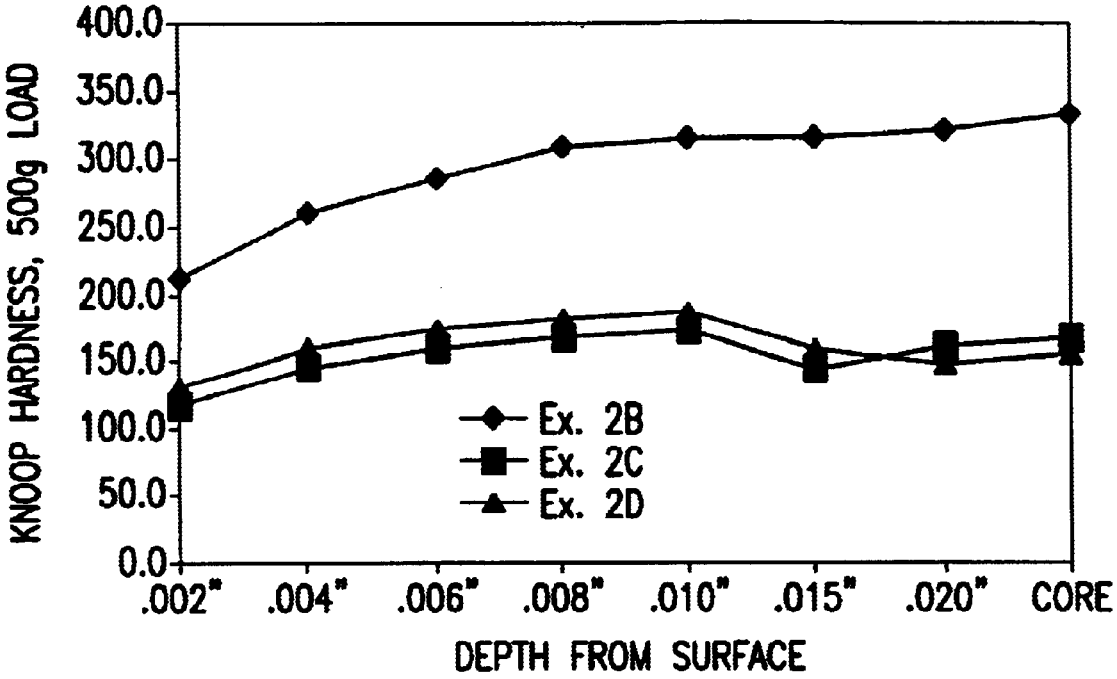
FIG. 5 is a graph of hardness vs. depth for exemplary shot according to principles of the invention.

A series of annealing experiments were performed in a belt furnace on #4 and #7 shot. The atmosphere was a rich exothermic gas consisting essentially by volume of 71.5% $N_2$, 10.5% CO, 5% $CO_2$, 12.5% $H_2$, and 0.5% $CH_4$ having a dew point of 50–60° F. In Example 2A, the #7 shot were heat treated at 1121–1177° C. (2050–2150° F.) for 30 minutes in the decarburizing atmosphere. Namely, the belt speed was set to one-third foot per minute through a ten foot hot zone. A forty foot cooling zone provided two hours of cooldown time. The treatment was intended to simulate the effect of the same exposure to the same atmosphere at 1600° F. (871° C.) for 2.5 hours. When loaded about ¾ inch deep in wire mesh baskets the result was a shallow, uneven decarburized layer. The variability in the hardness at a given depth is believed to be due to uneven decarburization caused by poor gas penetration into the bed of pellets traveling through the furnace. This was overcome by placing only one layer of pellets at a time in wire mesh baskets. To increase the depth and uniformity of the decarburized layer the shot was passed through the furnace three times, with 30 minutes of heating per pass. This resulted in the decarburized layer reaching the center of the pellet (complete decarburization). FIG. 5 shows the resulting hardness for #7 shot at various depths after each pass through the furnace (Examples 2B–D, respectively). As can be seen from FIG. 5, complete decarburization was essentially achieved after sixty (two thirty minute passes) minutes at 1177° C. (2150° F.). The residual carbon content of these pellets was measured at 0.053%, a carbon level comparable to that of the current wire-formed shot usually made from SAE 1006 wire having a carbon content of 0.04–0.06%. The pellet hardness was still about 150 DPH, primarily due to the silicon and manganese content. These results indicate that the exemplary water-atomized shot cannot readily be decarburized to the same hardness as the wire-formed shot due to the former's chemistry (i.e., the presence of Si and Mn). The 50% higher hardness might be expected to cause more barrel damage on firing. A single pass partial decarburation was additionally performed on #4 shot (Example 2E).

Example 3

Figure 6:
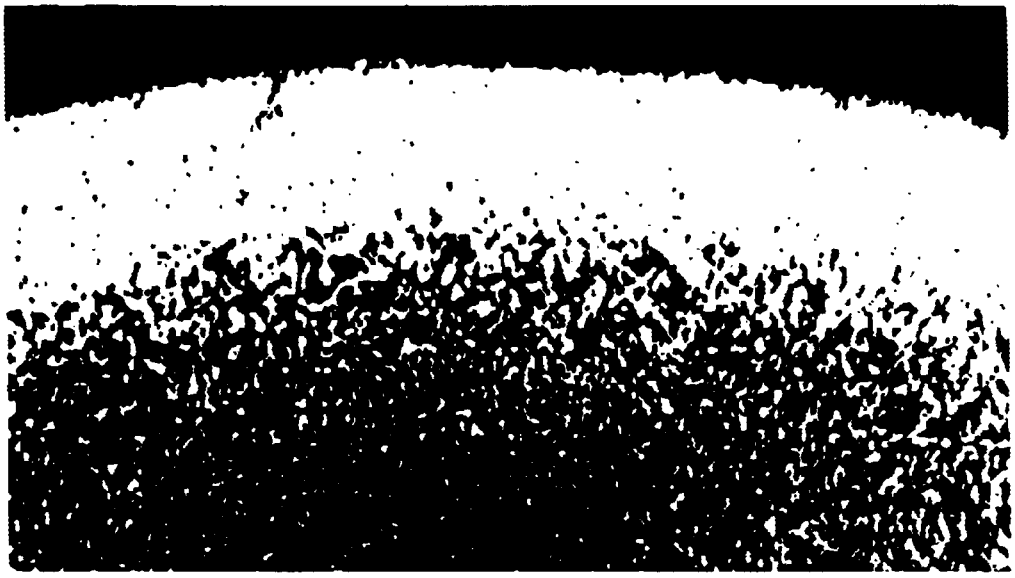
FIGS. 6–13 are 100× photomicrographs of decarburized steel shot according to principles of the invention.
Figure 7:
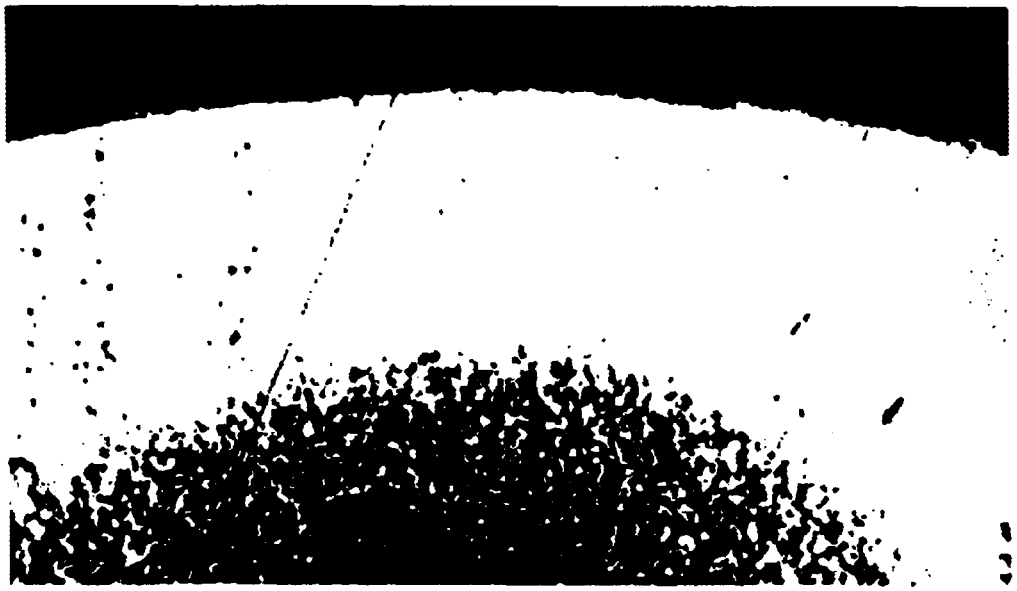
Figure 8:
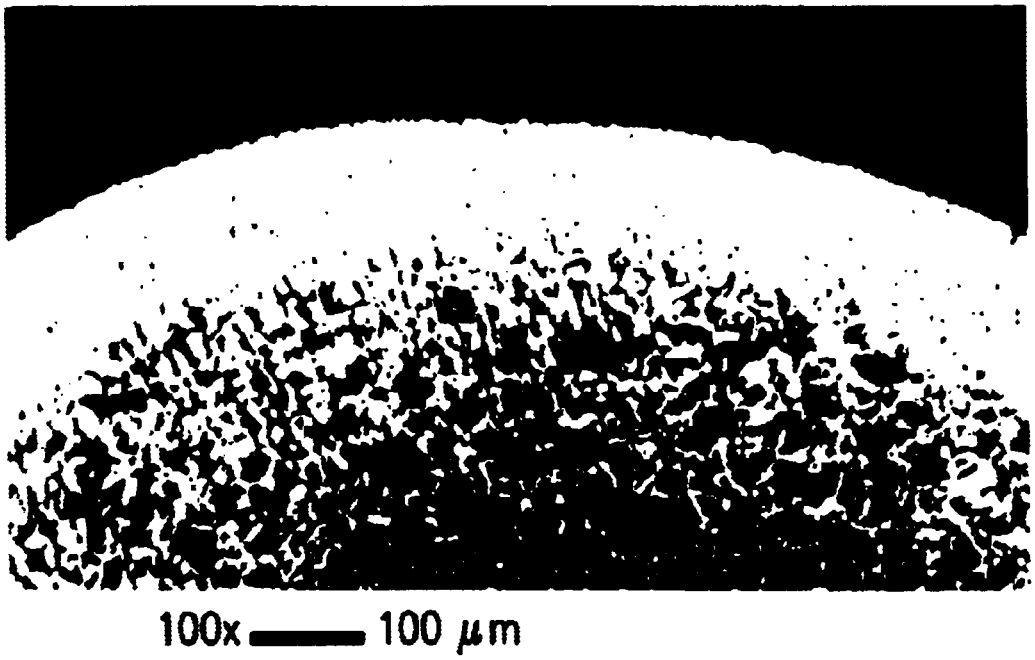
Figure 9:
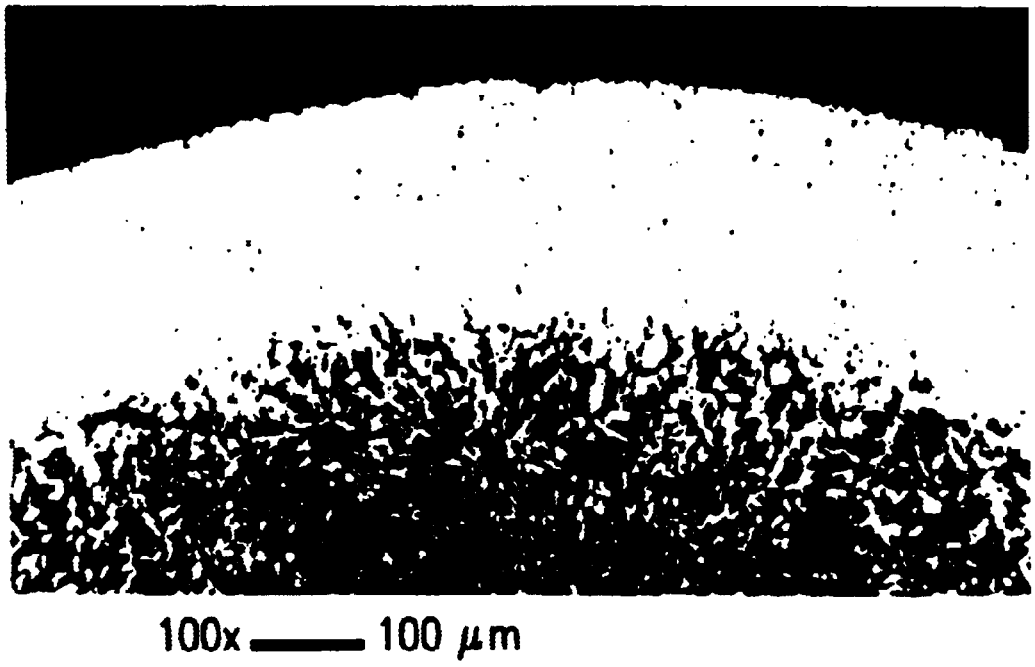
Figure 10:
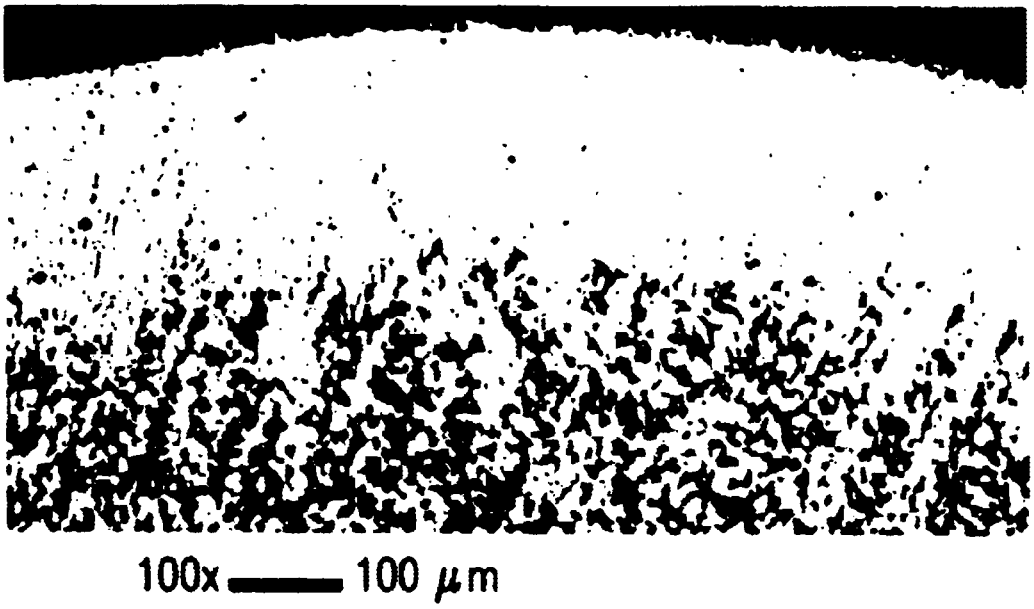
Figure 11:
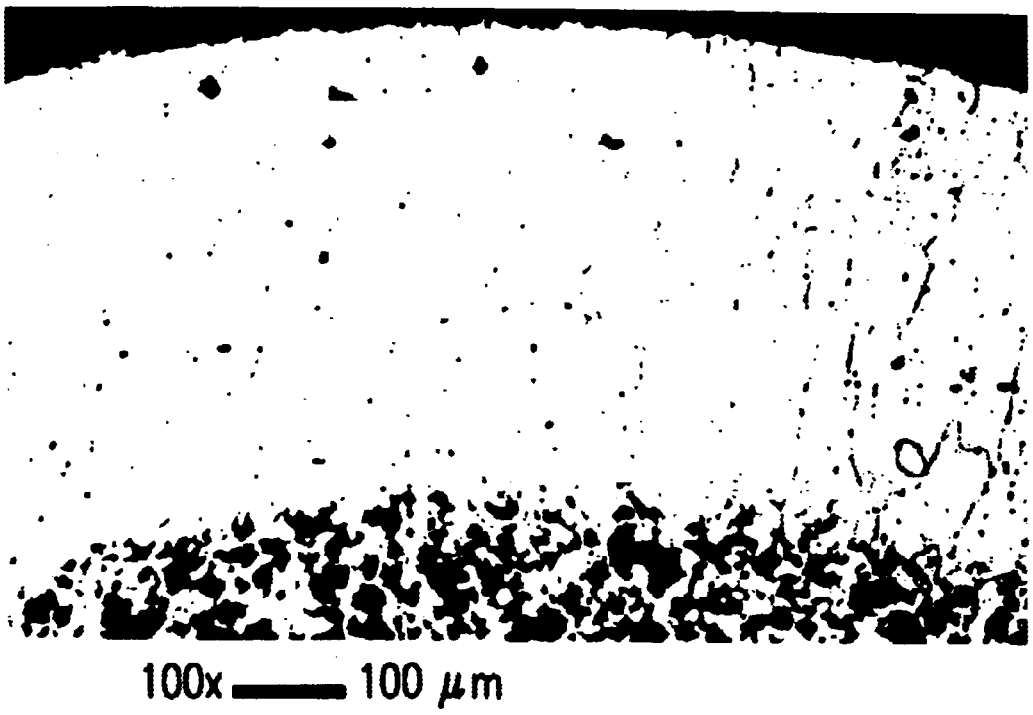
Figure 12:
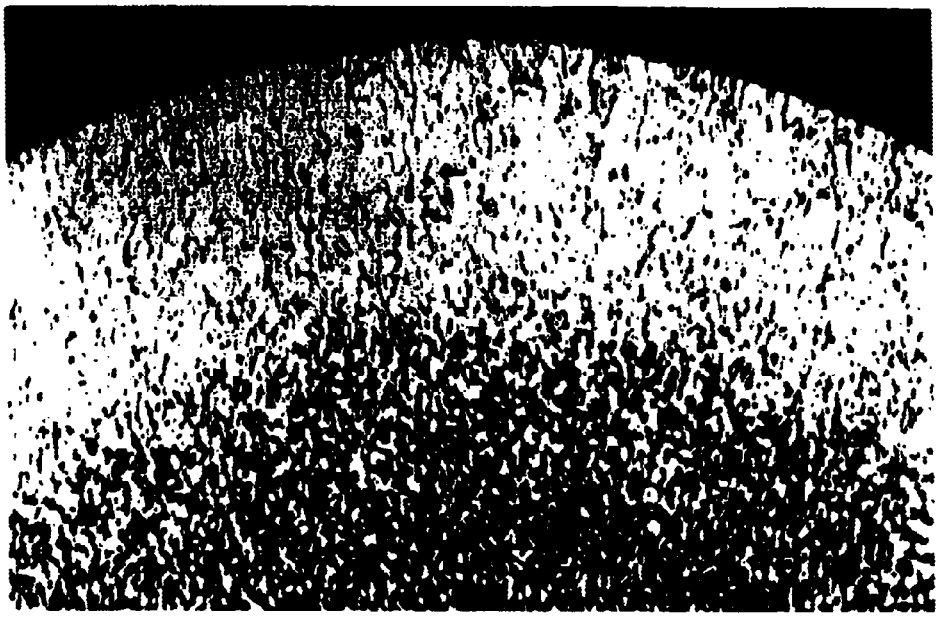
Figure 13:
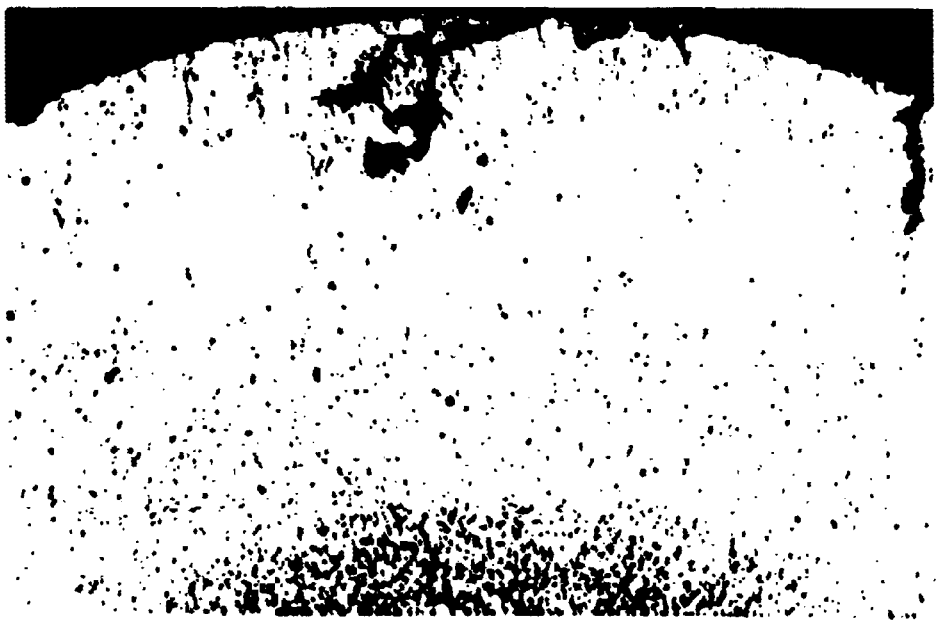

Two sets of samples were decarburized in a rotating kiln which allowed the annealing atmosphere to contact all of the pellets surface evenly. The first set decarburized involved #4 and #7 shot, designated Examples 3A and 3B, respectively. The second set involved #4 and #2 shot, designated Examples 3C and 3D, respectively. For each of Examples 3A–3D a series of approximately 5–7 pellets were sectioned and the decarburized layer observed. For each example, a pellet having a relatively thin decarburized layer and a pellet having a relatively thick decarburized layer are shown in the figures. FIGS. 6 and 7 are photomicrographs of Ex. 3A pellets respectively having thin and thick decarburized layers. Similar thin and thick layers are shown in FIGS. 8 and 9 for Ex. 3B, FIGS. 10 and 11 for Ex. 3C, and FIGS. 12 and 13 for Ex. 3D. The measured depth of the decarburized layer is noted beneath each photomicrograph. It is seen that the decarburized layer 120 is fairly uniform within each pellet, but does vary somewhat from pellet to pellet.

Microhardness tests using a 100 g load and a Vickers indenter were conducted on these samples approximately in the center of the decarburized layer and also in the center of the pellet (which was not decarburized). These results are summarized in Tables 1 and 2.

TABLE 1

Vickers Hardness for Examples 3A and 3B

| | Hardness ($HV_{100\ g}$) | | | |
|---|---|---|---|---|
| | Example 3A | | Example 3B | |
| Pellet | Decarburized Layer | Center | Decarburized Layer | Center |
| 1 | 187 | 417 | 187 | 332 |
| | 172 | 383 | 177 | 324 |
| 2 | 181 | 331 | 161 | 301 |
| | 188 | 343 | 159 | 312 |
| 3 | 160 | 353 | 165 | 285 |
| | 168 | 341 | 172 | 342 |
| 4 | 179 | 342 | 130 | 310 |
| | 186 | 337 | 128 | 300 |
| 5 | 183 | 321 | 150 | 303 |
| | 178 | 336 | 123 | 299 |
| Minimum | 160 | 321 | 123 | 285 |
| Maximum | 188 | 417 | 187 | 342 |
| Average | 178 | 350 | 155 | 311 |

TABLE 2

Vickers Hardness for Examples 3C and 3D

| | Hardness ($HV_{100\ g}$) | | | |
|---|---|---|---|---|
| | Example 3C | | Example 3D | |
| Pellet | Decarburized Layer | Center | Decarburized Layer | Center |
| 1 | 165 | 278 | 180 | 268 |
| | 167 | 281 | 185 | 286 |
| | 162 | 297 | 171 | 275 |
| | 171 | 283 | 176 | 280 |
| | 159 | 274 | 171 | 278 |
| | 165 | 289 | 178 | 292 |
| 2 | 165 | 272 | 169 | 222 |
| | 162 | 257 | 159 | 193 |
| 3 | 161 | 330 | 162 | 243 |
| | 186 | 323 | 169 | 254 |
| 4 | 184 | 260 | 181 | 280 |
| | 177 | 289 | 185 | 228 |
| 5 | 181 | 258 | 171 | 204 |
| | 182 | 270 | 193 | 210 |
| Minimum | 159 | 257 | 159 | 193 |
| Maximum | 186 | 330 | 193 | 292 |
| Average | 171 | 283 | 175 | 251 |

Figure 14:
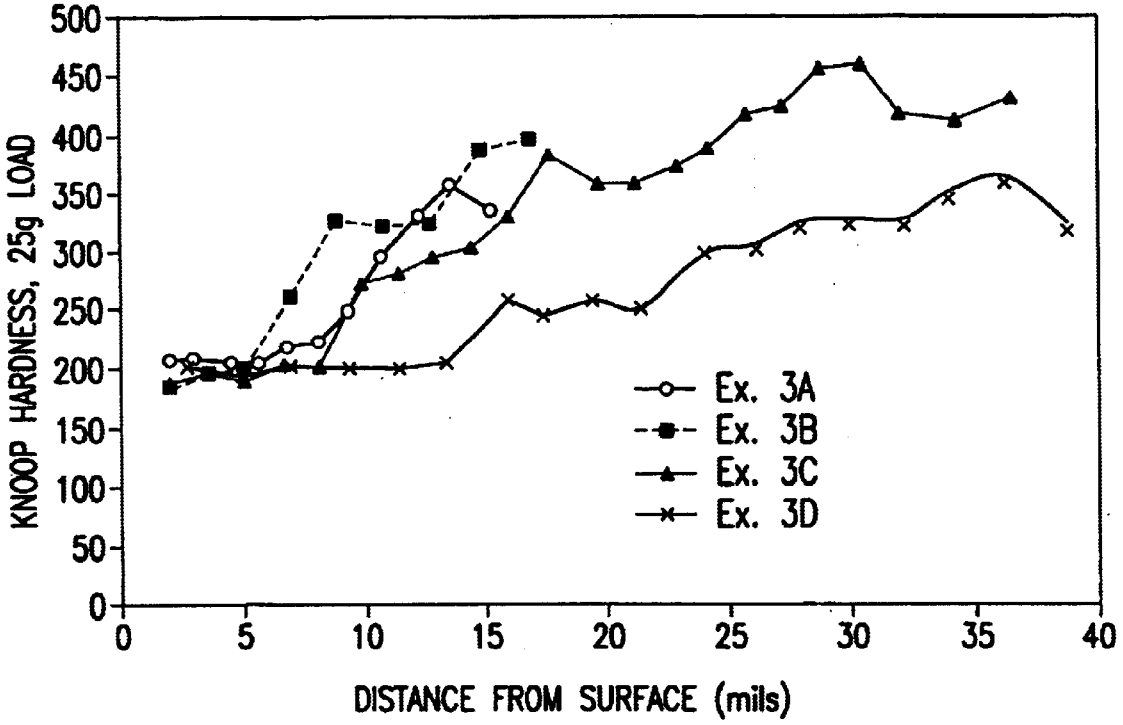
FIG. 14 is a graph of hardness vs. depth for exemplary shot according to principles of the invention.

In addition a hardness scan was conducted across the decarburized layer in one pellet from each lot using a 25 g load and a Knoop indenter. These results are plotted in FIG. 14. The results show that the average hardness in the decarburized layer is between 155 and 178 on the Vickers scale and that the center region averages between 251 and 350 on the same scale. The hardness scans indicate that the decarburized layer has a fairly uniform hardness which increases gradually to the core hardness.

Firing Tests

Various firing tests were performed on the water-atomized shot (hereinafter identified as "cast") and on conventional wire-formed low carbon steel shot serving as a control. The cast shot included samples of: (a) completely decarburized shot; (b) partially decarburized shot; (c) annealed but not decarburized shot (serving as a reference or control to observe the effects of decarburization). Additionally, there was limited firing of untreated cast shot. The untreated shot pellets were extremely hard and readily gouged, scored and otherwise deformed the shotgun barrels after firing only a few rounds. Results for such untreated shot are not reported. All tests were of 12-gauge shotshells with shot weights, shotwad sidewall thickness, and velocities as shown. All shotguns were of modern manufacture (typical barrel hardness about Rockwell B 80–85) and, for the barrel stress tests, were full choke.

1. Patterning

The shape of the atomized particles is relatively spheroidal, but not nearly like that of the wire-formed shot. FIG. 3 shows #7 water-atomized shot after screening for size, shape and density. Pattern performance was measured by loading the shot in shotshells and firing it at a target. The measured pattern percentage is the percentage of the shot that hits the target within a given area of the target (e.g., within a thirty inch circle). Pattern performance would not be expected to be satisfactory for ballistic applications, and certainly not nearly as good as that of the wire-formed shot. However, with proper separation techniques it was found that the more grossly non-spherical pellets could be removed. When compared to the standard wire-formed shot it was found that the remaining, more nearly spherical, cast shot pellets (i.e., those shown in FIG. 3) would consistently throw a similar percentage of pellets into the standard thirty inch pattern circle at forty yards. This was true whether fired through full, modified, or improved cylinder choked guns.

The results of several pattern comparisons follow in Table 3. The annealed-only sample of 0.10 inch diameter cast shot gave consistently similar pattern performance to the wire-formed control, whether loaded in 1 oz, or 1⅛ oz configurations, or fired through the full or modified choke constrictions. In ten round pattern tests such as these, a 5–6% pattern differential is generally required to show a statistically significant difference at the 90% confidence level. Another set of tests with the fully decarburized #7 (0.10 inch) cast shot showed statistically equivalent results for the cast and wire-formed shot when loaded in the 1 oz configuration and fired through either full, modified or improved cylinder chokes.

The annealed-only cast #4 (0.13 inch) shot performed similar to the wire-formed control when loaded in the 1 oz configuration and fired through a full choke barrel. When loaded in the 1¼ oz configuration, the cast performed somewhat better than one sample of wire-formed shot but somewhat poorer than another. The low pattern percentage of test 1 is thought to be due to a batch of wire-formed shot with unusually poor shape. No decarburized #4 shot was used in this test.

TABLE 3

40 Yd Steel Shot Pattern Data

| Shot Sample | Heat Treatment | Load (oz.) | Velocity (fps) | Choke | 30" Circle Pattern |
|---|---|---|---|---|---|
| Control #7 cast | anneal only | 1 | 1235 | Full | 70% |
| Control #7 wire-formed | anneal only | 1 | 1235 | Full | 72% |
| Control #7 cast | anneal only | 1 ⅛ | 1325 | Full | 68% |
| Control #7 wire-formed | anneal only | 1 ⅛ | 1325 | Full | 69% |
| Control #7 cast | anneal only | 1 ⅛ | 1325 | Modified | 61% |

TABLE 3-continued

40 Yd Steel Shot Pattern Data

| Shot Sample | Heat Treatment | Load (oz.) | Velocity (fps) | Choke | 30" Circle Pattern |
|---|---|---|---|---|---|
| Control #7 wire-formed | anneal only | 1 ⅛ | 1325 | Modified | 63% |
| Ex. 2C #7 cast | full decarb. | 1 | 1235 | Full | 69% |
| Control #7 wire-formed | anneal only | 1 | 1235 | Full | 69% |
| Ex. 2C #7 cast | full decarb. | 1 | 1235 | Modified | 61% |
| Control #7 wire-formed | anneal only | 1 | 1235 | Modified | 64% |
| Ex. 2C #7 cast | full decarb. | 1 | 1235 | Imp. Cyl. | 48% |
| Control #7 wire-formed | anneal only | 1 | 1235 | Imp. Cyl. | 50% |
| Control #4 cast | anneal only | 1 | 1375 | Full | 71% |
| Control #4 wire-formed | anneal only | 1 | 1375 | Full | 74% |
| Control #4 cast | anneal only | 1 | 1375 | Modified | 65% |
| Control #4 wire-formed | anneal only | 1 | 1375 | Modified | 71% |
| Control #4 cast | anneal only | 1 ¼ | 1275 | Full | 74% |
| Control #4 wire-formed test #1 | anneal only | 1 ¼ | 1275 | Full | 68% |
| Control #4 wire-formed test #2 | anneal only | 1 ¼ | 1275 | Full | 80% |

A conclusion which can be drawn from the data is that the properly culled cast steel shot is seen to pattern roughly comparably to the currently used wire-formed shot, and certainly well enough to be useful as shot in shotshells. This surprising finding gave credence to the possible use of these pellets as shot.

2. Barrel Stress

Firing tests for residual strain are summarized in Table 4. When fired in the annealed-only condition (first line in Table 4), the control #7 (0.10 inch diameter) cast steel shot gave four times the maximum change (residual strain) in choke internal diameter (ID) as did the standard wire-formed shot when loaded as a 1 oz load. The same size shot which had been completely decarburized (Example 2C) gave essentially identical results to the control wire-formed shot when loaded in the same 1 oz load. This is despite being roughly fifty points harder than the wire-formed control.

When fired in the annealed-only condition, the #4 (0.13 inch diameter) cast steel shot, which was approximately two to three times harder than the wire-formed control, gave roughly eight times greater choke residual strain when loaded in the 1¼ oz configuration. However, with the partial decarburization of Example 2E, the pellets being softened to 156 DPH at 0.004 inch from the surface and 245 DPH at the core, the resulting residual strain was cut by roughly three-fourths, to only twice that of the control.

When loaded as a higher velocity 1 oz load (e.g., for a muzzle velocity of 1300 feet per second (fps), the Example 3B partially decarburized #7 (0.10 inch diameter) cast shot having a decarburized surface layer ranging from 0.006–0.009 inch thick (see FIGS. 8 and 9, gave similar maximum barrel residual strain to both the completely decarburized #7 (0.10 inch diameter) cast shot of Example 2C and the wire-formed, annealed, low carbon control. The Example 3A partially decarburized #4 (0.13 inch diameter) cast shot, having a decarburized surface layer ranging from 0.006–0.010 inch thick (see FIGS. 6 and 7), gave roughly equivalent residual strain to that of the annealed wire-formed control when loaded as a high velocity 1 oz load, and ½ that of annealed-only cast shot. When loaded in a 1⅛ oz configuration, Example 3D partially decarburized #2 (0.15 inch diameter) cast steel shot, having a decarburized layer ranging from 0.018–0.025 inch (see FIGS. 12 and 13) performed similar to the softer wire-formed shot. This same shot loaded in a 1¼ oz load gave very little residual strain (0.0004 inch max. ID expansion in the choke area).

TABLE 4

Barrel Wear Evaluations with Various Steel Shot Samples

| Shot Sample | Heat Treatment | Shot Hardness @ Given Depth Scale | Depth (in) 0.004 | 0.015 | Core | Shot Weight (oz) | Nominal Velocity (fps) | Avg Wad Thickness (in) | Max ID Change (in) |
|---|---|---|---|---|---|---|---|---|---|
| Control #7 cast | Anneal only | KHN | 242 | 288 | 289 | 1 | 1235 | 0.030 | 0.0016 |
| | | | | | | | 1315 | 0.042 | 0.0005 |
| Control #7 wire-formed | Anneal only | DPH | nm | 103 | nm | 1 | 1235 | 0.030 | 0.0004 |
| Ex. 2C #7 cast | Complete decarb. | KHN | 158 | 156 | 159 | 1 | 1235 | 0.030 | 0.0003 |
| | | | | | | | | | 0.0004 |
| | | | | | | | 1300 | 0.042 | 0.0001 |
| | | | | | | | | | 0.0005 |
| Control #7 wire-formed | Anneal only | DPH | 90 | 97 | nm | 1 | 1235 | 0.030 | 0.0002 |
| | | | | | | | 1300 | 0.042 | 0.0003 |
| Ex. 3B #7 cast | Partial decarb. | DPH | 155 | nm | 300 | 1 | 1300 | 0.042 | 0.0006 |
| Control #4 cast | Anneal only | KHN | 233 | 262 | 323 | 1¼ | 1320 | 0.035 | 0.0074 |
| | | | | | | 1 | 1400 | 0.042 | 0.0027 |
| Control #4 wire-formed | Anneal only | DPH | nm | 104 | nm | 1¼ | 1320 | 0.035 | 0.0009 |

TABLE 4-continued

Barrel Wear Evaluations with Various Steel Shot Samples

| Shot Sample | Heat Treatment | Shot Hardness @ Given Depth Scale | Depth (in) 0.004 | 0.015 | Core | Shot Weight (oz) | Nominal Velocity (fps) | Avg Wad Thickness (in) | Max ID Change (in) |
|---|---|---|---|---|---|---|---|---|---|
| Ex. 2E #4 cast | Partial decarb. | DPH | 156 | 185 | 245 | 1¼ | 1290 | 0.035 | 0.0018 |
| Ex. 3A #4 cast | Partial decarb. | DPH | 178 | nm | 350 | 1 | 1450 | 0.042 | 0.0013 |
| Control #4 wire-formed | Anneal only | DPH | nm | 104 | nm | 1 | 1450 | 0.042 | 0.0014 |
| Control #2 wire-formed | Anneal only | DPH | nm | 97 | nm | 1⅛ | 1345 | 0.040 | 0.0016 |
| Ex. 3D #2 cast | Partial decarb. | DPH | nm | 175 | 251 | 1⅛ | 1315 | 0.040 | 0.0020 |
| | | | | | | 1¼ | 1295 | 0.040 | 0.0004 |

nm = not measured

Again these results confirm that partially decarburized cast steel shot, characterized as having a 0.006 to 0.020 inch thick decarburized surface layer over a harder core, gave barrel deformation test results essentially similar to those of the fully decarburized cast shot and the standard wire-formed shot. This is despite having a minimum surface hardness that is generally 50 to 70 DPH higher than the standard wire-formed shot conventionally used in the ammunition industry.

The results of these firing tests show that especially for larger shot annealing alone is insufficient to yield shot which gives satisfactory firing results, since maximum changes in barrel ID in these tests were four to eight times greater than for the standard wire-formed shot. These data also show that the Example 2C fully decarburized #7 shot give essentially the same test results despite being roughly fifty points harder than the wire-formed shot. Another noteworthy conclusion from this data is that the Example 3B partially decarburized shot with an outer surface similar in hardness to the fully decarburized shot, but with a harder core, performed much the same as the fully decarburized shot.

It can further be seen that the barrel wear is related not only to surface hardness but to shot size (diameter). For a given acceptable level of barrel wear, the maximum acceptable level of hardness decreases as shot diameter increases. By way of example, it is seen from Table 4 that the annealed-only #7 cast shot produces approximately the same ID change as the #2 wire-formed control (although fired at slightly different nominal velocities). This gives rise to the possibility of using very slightly decarburized, or even annealed-only shot in smaller shot sizes. With annealed-only shot, slightly increased wad thickness may compensate for increased hardness as can be seen in Table 4 by comparing the #7 annealed-only cast shot fired with a 0.042 inch wad with the #7 wire-formed shot fired with a 0.030 inch wad. The use of an annealed-only shot is particularly advantageous in upland game loads as a replacement for lead shot. Relative to waterfowl loads, upland game loads use a larger number of smaller shot pellets. As the number of pellets per load increases as pellet size decreases, loading shotshells with wire-formed shot is relatively expensive in smaller shot diameters. This is the case as certain of the costs, such as the cost of cutting the wire, do not vary greatly on a pellet-by-pellet basis with the size of such pellets. By way of example, a #7 (nominal diameter 0.10 in) pellet might thus be useful at hardness up to about 300 Vickers (DPH). Slightly less hard #6 shot would also be similarly useful as well would a non-standard #6½ (nominal diameter 0.105 in) which might form an advantageous substitute for #7½ lead shot. Determining the relationship between maximum acceptable hardness and shot size for a given level of barrel wear may require significant experimentation in view of a variety of desired parameters such as the shotshell gauge, shot loads, propellant loads and wadding type as well as the particular shotguns and chokes utilized. The exact relationship under given conditions may not be linear and may not even be monotonically decreasing. Particular ones of the relatively large size of shot may, when packed in a given arrangement, impose particularly high stresses on shotgun barrels and chokes that might not be present with yet larger shot packed differently. As smaller shot will behave more like a fluid, at very small sizes, the acceptable hardness may be relatively insensitive to diameter. Similarly, at relatively large sizes, where movement of pellets is restricted, there may also be insensitivity. Thus, in one approximation, there may be a near step relationship between pellet size and acceptable hardness. For example, pellets #4 size and larger might need to be below a given hardness (e.g., 250 DPH) while pellets smaller than #4 may be harder (e.g., maximum hardness of 300 DPH). As described above, these smaller pellets could be annealed-only or slightly decarburized, having an exemplary hardness from about 225 to about 300.

A linear approximation of a functional relation between pellet size and maximum diameter, however, may be attempted. Where D is the characteristic diameter of a pellet and H is the associated maximum desired hardness under the desired circumstances, H may be approximated as a linear function of D, based upon values of H for two known values of D as:

$$H=H_1+((D-D_1)(H_2-H_1)/(D_2-D_1)).$$

By way of example, utilizing #7 and #2 shot, the known values of D are, respectively, 0.10 and 0.15 inches. At a first, set of relatively high hardness levels, respective values of $H_1$ and $H_2$ would be 300 and 200 Vickers (DPH). A more conservative pair of hardness values would be 275 and 180, respectively. Other values based upon the examples given in the tables above may be utilized to calculate other functional ranges of hardness for various purposes.

Subsequently-developed data tends to bear the foregoing out. Table 5 shows firing data for #6 cast shot drawn from SAE J827 material. Test parameters were similar to those of Table 4 with one-ounce loads, 1300 fps velocity and 0.042 inch shot cup petal thickness. A first shot sample was heavily annealed without a decarburizing atmosphere to approximately minimize hardness without decarburization. Surface hardness for this material was very roughly 240 DPH (measured in section just in board of the surface). A second sample was less annealed and is identified as "tempered only" consistent with shot commonly used in the surface preparation industry and having a surface hardness of roughly 325 DPH. As a control, shot with substantial decarburization and having an approximate surface hardness of 160 DPH was utilized. While some of the recorded data is probably within the margin of error, relatively large deformations are consistently observed with the tempered only shot. In addition to the change in diameter (measured via average of three thirty degree offset readings of a three-point micrometer for the ID and two ninety degree flat caliper readings for the OD) the tempered only sample produced numerous grooves in the internal surface of the choke which were visible and could be felt with a finger. Several grooves were also noticed in the barrel forcing cone. No such grooves were noticed with the decarburized shot and relatively small number of light grooves were noticed in the choke of the carrel used with the annealed shot. Either an increase in petal thickness or other change to the shot cup or at least a slight decrease in hardness would appear advantageous for use of the tempered only shot. It is accordingly believed that #6 shot of approximately 300 DPH should still be acceptable with the identified shot cup. Clearly, the use of harder shot, while not precluded, raises additional barrel wear considerations.

TABLE 5

Barrel/Choke Deformation (thousandths of an inch) #6 Shot 0.042 Petal Thickness HDPE Shot Cup, Full Choke

| Shot Sample | Number of Rds. | ID/ OD | Distance from Muzzle (inches) 1.5 | 1.25 | 1 | 0.75 | 0.5 | 0.25 | ~0 |
|---|---|---|---|---|---|---|---|---|---|
| Heavily annealed without significant decarburization ~240 DPH | 500 | ID | .0 | −.2 | −.1 | −.1 | .0 | .2 | .4 |
| | | OD | .0 | .0 | .1 | .2 | .1 | −.1 | −.1 |
| | 2000 | ID | .1 | −.1 | .0 | .1 | .1 | .2 | .4 |
| | | OD | −.1 | −.1 | .2 | .2 | .1 | .0 | .0 |
| | 5000 | ID | .1 | .1 | .2 | .0 | .2 | .3 | .4 |
| | | OD | −.1 | −.1 | .0 | .0 | .0 | .0 | .0 |
| Tempered only ~325 DPH | 500 | ID | .0 | .0 | .1 | .2 | .6 | .5 | −.1 |
| | | OD | .2 | −.3 | −.3 | −.2 | −.1 | .4 | na |
| | 2000 | ID | .0 | .0 | .2 | .3 | .6 | .6 | −.1 |
| | | OD | .2 | −.1 | −.2 | .1 | .0 | .6 | na |
| | 5000 | ID | .3 | .4 | .4 | .4 | .9 | .6 | .3 |
| | | OD | .5 | .6 | .7 | 1.0 | .8 | 1.0 | na |
| Annealed with significant decarburization ~160 DPH | 500 | ID | −.1 | .1 | .3 | .2 | .3 | .1 | .2 |
| | | OD | .2 | .2 | .1 | .0 | .2 | .0 | .2 |
| | 2000 | ID | .1 | −.1 | .3 | .2 | .2 | .1 | .2 |
| | | OD | .2 | .3 | .2 | .0 | .2 | .2 | .4 |
| | 4100 | ID | .1 | .0 | .1 | .2 | .3 | .2 | .3 |
| | | OD | .2 | .2 | .2 | .1 | .2 | .1 | .3 |

While the foregoing examples entail the use of the exemplary SAE J827 shot, other compositions may be used. Many are less preferred as feedstock. For example, a somewhat lower carbon content is found in SAE specification J2175 Low Carbon Cast Steel Shot. This steel has a composition as follows: 0.10–0.15% C; 0.10–0.25% Si; 1.20–1.50% Mn; 0.05–0.15% Al; maximum 0.035% P; and maximum 0.035% S, with remainder Fe and impurities. Knoop hardness for this material is typically above 400. Once decarburized, one chemical difference between this steel and the J827 material utilized in the examples will be in the relative proportions of Si and Mn. However, in decarburized samples of both J827 and J2175 steel there will be significant observable levels of one or both of these elements.

As utilized in the claims, the respective Knoop and Vickers hardnesses are those hardnesses measured using conventional methods with indenters of 25 g and 100 g, respectively.

One or more embodiments of the present invention have been described. Nevertheless, it will be understood that various modifications may be made without departing from the spirit and scope of the invention. For example, various process steps may be reconfigured or rearranged to the extent that this would not prevent obtaining the ultimately desired product. For example, the size-sorting of the ballistic shot and the decarburization of such ballistic shot may be reversed. Additionally, there may be additional processing steps involving either the ballistic shot, the industrial shot, the grit, or any combination thereof. Other atomization processes such as centrifugal/rotating disk atomization may be utilized. Accordingly, other embodiments are within the scope of the following claims.

What is claimed is:

1. A method for manufacturing shot useful for discharge from a shotgun comprising:

providing a source of molten steel having an initial carbon content;

subjecting the molten steel to an atomization process so as to produce substantially spheroidal pellets;

annealing the pellets in a decarburizing atmosphere effective to decrease the carbon content in at least a surface layer of each of the pellets;

cooling the pellets, whereupon, on average the surface layer has a median Knoop hardness of less than 225 at 21° C.; and packaging the pellets in packages labeled as for use in loading shotshells.

2. The method of claim 1 wherein the atomization process comprises water atomization.

3. The method of claim 1 wherein the surface layer is at least 0.1 mm thick.

4. The method of claim 3 wherein the surface layer is at least 0.3 mm thick.

5. The method of claim 1 wherein the surface layer has a thickness of at least 1% of an average diameter of the associated pellet.

6. The method of claim 5 wherein the surface layer has a thickness of 5%–10% of an average diameter of the associated pellet and the carbon removal is effective to provide the surface layer with a Knoop hardness of less than 225 at 21° C. over substantially the entire surface layer.

7. The method of claim 1 wherein a core region of the pellet located radially inward of the surface layer has an average diameter of at least 50% of an average diameter of the associated pellet.

8. The method of claim 1 wherein the carbon removal is effective to provide the surface layer with a Vickers hardness of no more than 180 at 21° C. over a majority of the surface layer.

9. The method of claim 8 wherein the carbon removal is effective to provide the pellets with a Vickers hardness of between 130 and 180 at 21° C. substantially throughout.

10. The method of claim 1 wherein the spheroidal pellets have characteristic diameters between 0.08 inch and 0.23 inch.

11. The method of claim 10 wherein the pellets are #4 pellets and the subjecting step produces additional pellets and the method further comprises separating the additional pellets from the #4 pellets prior to the annealing step.

12. The method of claim 1 wherein the annealing leaves sufficient carbon in a core region of each pellet so that a majority of the core region has a Vickers hardness of more than 200 at 21° C. and the carbon removal is effective to provide the surface layer with a Vickers hardness of between 130 and 180 at 21° C. over a majority of the surface layer.

13. The method of claim 12 wherein prior to annealing the pellets have a combined manganese and silicon concentration of at least 0.8% by weight.

14. The method of claim 12 wherein prior to annealing the pellets have a composition by weight of:

0.85–1.2% carbon;

0.4–1.2% manganese;

0.4–1.5% silicon; and remainder iron with up to 1% additional components.

15. A method for manufacturing shot useful for discharge from a shotgun comprising:

providing a source of molten steel having an initial carbon content;

subjecting the molten steel to an atomization process so as to produce substantially spheroidal pellets;

annealing the pellets in a decarburizing atmosphere effective to decrease the carbon content in at least a surface layer of each of the pellets;

cooling the pellets, whereupon, on average the surface layer has a median Knoop hardness of less than 225 at 21° C.; and loading the pellets into shotshells.

16. A method for efficient manufacturing of shot for discharge from a shotgun comprising:

providing a source of molten steel;

subjecting the molten steel to an atomization process so as to produce particles;

segregating the particles into a plurality of groups based upon at least one parameter of particle size and particle shape, said plurality of groups including:

at least one ballistic group predominately designated for ballistic use wherein the particles are substantially spheroidal pellets having characteristic diameters between 0.08 inch and 0.23 inch; and at least one industrial group predominately intended for industrial use;

annealing the pellets of the ballistic group in a decarburizing atmosphere effective to remove carbon from at least a layer of each of said spheroidal pellets;

allowing the pellets of the ballistic group to cool, the carbon removal being effective to, on average, provide the layer with a Knoop hardness of less than 225 at 21° C. over a majority of the layer; and packaging the pellets of the ballistic group in packages labeled as for use in loading shotshells.

17. The method of claim 16 wherein:

the segregating includes:

segregating a plurality of such industrial groups of particle size and shape useful as industrial shot, leaving a first remainder of particles; and segregating said at least one ballistic group from said first remainder of particles, leaving a second remainder of particles.

18. The method of claim 17 further comprising:

crushing at least part of said second remainder to form industrial grit useful for grit blasting.

19. A method for manufacturing a shotload for discharge from a shotgun comprising the steps of:

providing a source of molten steel;

subjecting the molten steel to a water atomization process so as to produce substantially spheroidal pellets, each having a characteristic diameter (D) in inches;

annealing the spheroidal pellets;

cooling the pellets, whereupon on average at least a surface layer of each of the spheroidal pellets has a median Vickers hardness (H) of less than (300+((D−0.1)(−2000))) at 21° C.; and packaging the spheroidal pellets in packages labeled as for use in loading shotshells.

20. The method of claim 19 wherein the annealing comprises annealing the spheroidal pellets in a decarburizing atmosphere effective to decrease the carbon content in the surface layer of each of the spheroidal pellets.

21. The method of claim 19 wherein D is between 0.08 inch and 0.23 inch.

22. The method of claim 19 wherein prior to annealing the pellets have a composition by weight of:

0.85–1.2% carbon;

0.4–1.2% manganese;

0.4–1.5% silicon; and remainder iron with up to 1% additional components.

23. The method of claim 22 wherein H is than (275+((D−0.1)(−1900))) at 21° C.

24. A method for manufacturing a shotload for discharge from a shotgun comprising the steps of:

providing a source of molten steel;

subjecting the molten steel to a water atomization process so as to produce substantially spheroidal pellets;

annealing the pellets;

cooling the pellets, whereupon on average at least a surface layer of each pellet has a median Vickers hardness of less than 200 at 21° C. if such pellet is #4 size or larger and a Vickers hardness of between 200 and 300 at 21° C. if such pellet is smaller than #4 size, and packaging the pellets in packages labeled as for use in loading shotshells.

25. The method of claim 24 wherein the pellets are between #9 size and T-size, inclusive.

* * * * *

UNITED STATES PATENT AND TRADEMARK OFFICE

CERTIFICATE OF CORRECTION

PATENT NO. : 6,749,662 B2
DATED : June 15, 2004
INVENTOR(S) : Morris C. Buenemann, Jr. et al.

It is certified that error appears in the above-identified patent and that said Letters Patent is hereby corrected as shown below:

Title page,
Item [12], replace "Bueneman et al." with -- Buenemann, Jr. et al. --
Item [75], Inventors, replace "Morris C Bueneman" with -- Morris C. Buenemann, Jr. --
Item [56], References Cited, OTHER PUBLICATIONS, "Erwin Industries" reference, all occurrences of "Erwin" should be replaced with -- Ervin --
"Mazour, M.," reference, insert -- Less -- between "Loads" and "Expensive"
"Mann, M-J. et al.," reference, replace "194" with -- 1994 --
"ANSI/SAAMI" reference, replace "Z2292." with -- Z229.2 --; and insert -- Standards -- between "National" and "Institute"

Signed and Sealed this

Twenty-third Day of November, 2004

JON W. DUDAS
*Director of the United States Patent and Trademark Office*